United States Patent [19]

Tank

[11] 3,977,465

[45] Aug. 31, 1976

[54] SEALING ELEMENT FOR A REGENERATIVE HEAT-EXCHANGER

[75] Inventor: Eggert Tank, Fellbach, Germany

[73] Assignee: Daimler-Benz Aktiengesellschaft, Germany

[22] Filed: Aug. 1, 1974

[21] Appl. No.: 493,840

[30] Foreign Application Priority Data

Aug. 10, 1973 Germany ..... 2340531

[52] U.S. Cl. ..... 165/9; 277/88; 277/92; 277/227

[51] Int. Cl.[2] ..... F28D 19/00

[58] Field of Search ..... 165/9; 277/92, 88

[56] References Cited

UNITED STATES PATENTS

| | | | |
|---|---|---|---|
| 3,301,317 | 1/1967 | Weaving et al. | 165/9 X |
| 3,601,182 | 8/1970 | Rao et al. | 165/9 |
| 3,743,008 | 7/1973 | Zeek et al. | 165/9 |

*Primary Examiner*—Albert W. Davis, Jr.
*Attorney, Agent, or Firm*—Craig & Antonelli

[57] ABSTRACT

A sealing element between the storage body and a gas channel of a regenerative heat-exchanger, which consists of a slide layer of graphite, of a metallic support bar and of a connecting layer disposed therebetween; the support bar includes a bottom portion and two side portions which laterally surround in part the slide layer whereas the connecting layer is applied to the inner sides of the bottom portion and the side portions with the slide layer embedded in the connecting layer.

24 Claims, 4 Drawing Figures

SEALING ELEMENT FOR A REGENERATIVE HEAT-EXCHANGER

The present invention relates to a sealing element between the storage body and a gas channel of a regenerative heat-exchanger, which is composed of a slide layer of graphite, of a metallic support bar and of a connecting layer disposed therebetween.

With a known sealing element of this type (British Pat. No. 1,288,146) the two sides of the slide layer are aligned with those of the support bar which both have a rectangular cross-sectional area. The connecting layer consists of an elastic material for compensating the considerably larger thermal expansion of the used metals with respect to the graphite.

Such sealing elements made of in part only limited heat-resistant materials, such as graphites, are arranged in regenerative heat-exchangers between the so-called "cold side" of the rotatable storage body and the channel for the discharge of the already cooled off exhaust gases. Within the area of this seal, a large pressure difference exists between the low pressure of the far-reachingly relieved and cooled off exhaust gases in the channel and the high pressure of the compressed combustion air which prevails in the housing surrounding the channel. As a result thereof, the connecting layer which is deformed already by the differing thermal expansions of graphite and metal, is additionally stressed in particular by thrust forces. This may lead to an eventual untightness or even to a separation and disengagement of the connecting layer and therewith to a shearing off of the slide layer.

The present invention is concerned with the task to eliminate this disadvantage and to provide a sealing element which is resistant against mechanical and thermal loads and which under all operating conditions of the heat-exchanger reliably seals off the channel for the cooled off exhaust gases. This is realized according to the present invention in that the support bar consists of a bottom portion and of two side portions which laterally partly surround the slide layer, and in that connecting layer is applied along the inner sides of the bottom portion and of the side portions, in which is embedded the slide layer. As a result of these measures, the slide layer is securely anchored in the support bar and the connecting layer is relieved of thrust forces by the lateral parts of the support layer. Even in case of a local failure of the connecting layer, for example, as a result of becoming brittle or of burning of the material, the slide layer is still retained by the side portions of the support bar.

According to one embodiment of the present invention, the side portions of the support bar are provided with cut-outs or notches which are extended up to into the area of the bottom portion. As a result thereof, a certain yieldingness of the bottom portion of the support bar remains preserved notwithstanding the reinforcingly acting lateral portions so that the slide layer of the sealing element may well adapt and conform itself over its entire length to the storage body.

With a slide layer assembled of individual graphite blocks, the cutouts or notches are arranged according to the present invention within the area of the center of a side of each graphite block so that in each case the connecting layer between two graphite blocks is partially surrounded by the side portions of the support layer and is thus relieved of thrust forces.

The connecting layer according to the present invention may extend into the cutouts or notches provided in the side portions of the sheet metal support member and may fill out the same and may also form a transition from the top side of the lateral portions to the two sides of the slide layer, which projects above the support strip. These measures improve the embedding of the slide layer in the support bar and therewith increase the durability of the connection.

Accordingly, it is an object of the present invention to provide a sealing element for a regenerative heat-exchanger which avoids by simple means the aforementioned shortcomings encountered in the prior art.

Another object of the present invention resides in a sealing element for a regenerative heat-exchanger which is resistant against mechanical and thermal loads as occur under all operating conditions and which reliably seals the duct for the cooled off exhaust gases under all of these operating conditions.

A further object of the present invention resides in a sealing element in which the connecting layer between a slide layer and a support member is far-reachingly relieved of thrust forces, thereby precluding a shearing off of the slide layer.

Still a further object of the present invention resides in a sealing element of the type described above in which the slide layer is securely anchored in the support member while the connecting layer is far-reachingly relieved of any thrust forces by the lateral supports of the support member.

A still further object of the present invention resides in a sealing element for a regenerative heat-exchanger which is able to adapt itself over its entire length to the contour of the storage body.

Another object of the present invention resides in a sealing element of the type described above which excels by increased durability of the connection of the various components thereof.

These and other objects, features and advantages of the present invention will become more apparent from the following description when taken in connection with the accompanying drawing which shows, for purpses of illustration only, two embodiments in accordance with the present invention, and wherein.

Figure 1:
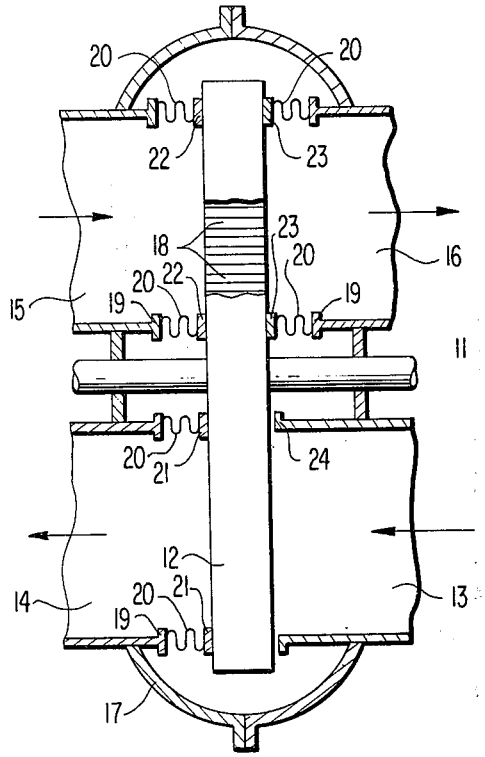
FIG. 1 is a schematic longitudinal cross-sectional view through a regenerative heat-exchanger equipped with a sealing element in accordance with the present invention.

Referring now to the drawing wherein like reference numerals are used throughout the various views to designate like parts, and more particularly to FIG. 1, the regenerative heat-exchanger illustrated in this figure of a motor vehicle gas turbine essentially consists of a disk-shaped storage body 12 of glass-ceramic material rotatably supported on a shaft 11, of channels 13 and 14 for the combustion air, of channels 15 and 16 for the exhaust gases and of a housing 17. The hot exhaust gases of the gas turbine are conducted during operation through the channel 15 to the storage body 12 which is set into rotation by a conventional drive (not shown), whereby the hot exhaust gases flow through the axial flow channels 18 of the storage body 12 and thereby give off a portion of their heat to the storage body 12. The cooled off exhaust gases leave the storage body 12 through the channel 16. The relatively cold combustion air supplied by the compressor of the gas turbine flows through the channel 13 into the part of the storage body 12 heated-up by the exhaust gases and absorbs thereat heat. The heated combustion air is fed through the channel 14 to the combustion chamber (not shown) of the gas turbine.

The channels or ducts 13 to 16 each have an approximately semicircularly shaped cross-sectional area which permit a good loading of the storage body 12. Metallic spring bellows 20 are mounted at the flanges 19 of the channels 14, 15 and 16, at which are secured sealing elements 21, 22 and 23, for example, by brazing, welding or riveting. The spring bellows 20 press the sealing elements 21 to 23 against the storage body 12 and prevent therewith an escape of gases out of the channels 14 to 16. No seal is necessary at the flange 24 of the channel 13 since the supplied combustion air within the housing 17 can take only the path through the storage body 12 into the channel 14 by reason of the sealing elements 21 to 23 of the remaining channels 14 to 16. The sealing element 23 of the channel 16 for the cooled off exhaust gases has a different composition and is of different construction as compared to the sealing elements 21 and 22 of the channel 14 for the heated air and of the channel 15 for the hot exhaust gases corresponding to the lesser thermal load.

Figure 2:
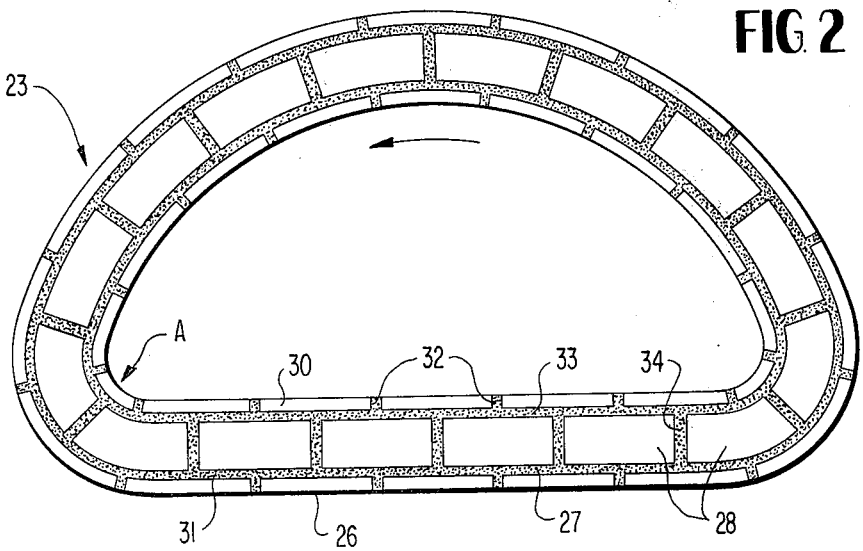
FIG. 2 is a plan view on the slide surface of a sealing element in accordance with the present invention as used with the heat-exchanger of FIG. 1.

As can be seen from FIG. 2, the sealing element generally designated by reference numeral 23 has a configuration corresponding to the semi-circularly shaped cross-sectional area of the channel 16. The direction of rotation of the storage body 12 is indicated by a curved arrow. The corner area of the sealing element 23 which is disposed in the direction of rotation and is most strongly loaded thermally is designated by reference character A.

Figure 3:
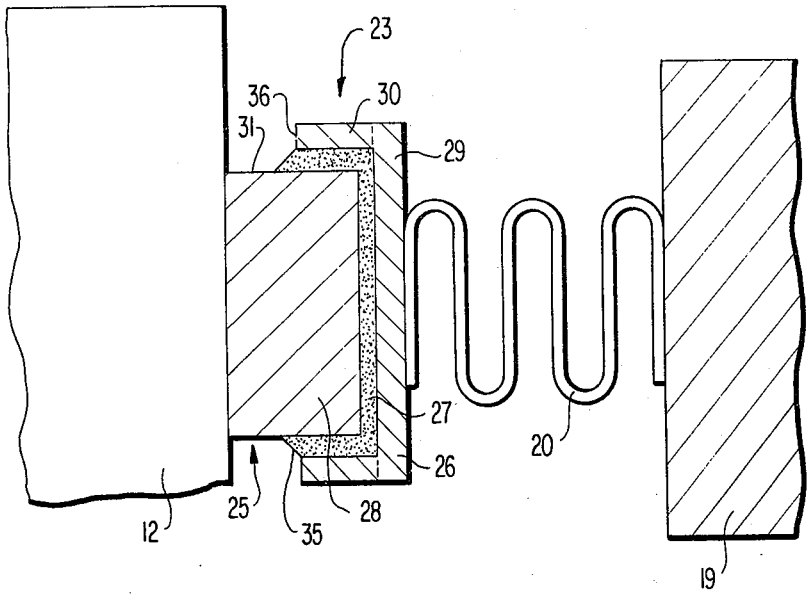
FIG. 3 is a cross-sectional view, on an enlarged scale, through the sealing element of FIG. 2.

As shown in FIG. 3, the sealing element 23 consists of a slide layer generally designated by reference numeral 25 abutting at the storage body 12, of a support bar 26 connected with the flange 19 of the channel 16 by way of the spring bellows 20 and of a connecting layer 27 disposed therebetween. The slide layer 25 is assembled of individual graphite blocks 28 arranged at slight spacings from one another. The support bar 26 consists of a bottom portion 29 and of two side portions 30 which are made from a ferritic steel and are connected with each other by brazing. Slots 32 (FIG. 2) are cut into the side portions 30 which partly surround the two sides 31 of the graphite blocks 28, for purposes of increasing the yieldingness of the support bar 26; the slots 32 extend up to the bottom portion 29 as shown by the dotted lines in FIGS. 3 and 4. The slots 32 are disposed in each case in the center of the sides 31 of the graphite blocks 28 (FIG. 2). The connecting layer 27 consists of a temperature-resistant silicon rubber of conventional type which is applied onto the inner side of the bottom portion 29 and of the side portions 30. The graphite blocks 28 are adhesively embedded in the connecting layer 27. The connecting layer 27, in addition to filling the gaps or joints 33 between the support bar 26 and the graphite blocks 28, also fills the gaps 34 between the individual graphite blocks 28. The length of the graphite blocks 28 and the width of the gaps 33 and 34 filled out by the connecting layer 27 are so selected that the differing thermal expansions between the slide layer 25 of graphite and the support bar 27 of steel are compensated by the elastic deformation of the silicon rubber of the connecting layer 27. The width of the gaps or joints 33 and 34 amounts, for example, to half a millimeter. The connecting layer 27 additionally fills out the slots 32 in the side portions 30 of the support bar 26. Additionally, the connecting layer 27 forms a transition 35 (FIG. 3) from the top side 36 of the side portions 30 to the two sides 31 of the graphite blocks 28, which transition extends beyond the support bar 26. As a result thereof, the graphite blocks 28 of the slide layer 25 are so securely embedded in the support bar 26 and the connecting layer 27 is so protected and relieved from thrust forces by the side portions 30 of the support bar 26 that the slide layer 25, even under large and alternating mechanical and thermal loads, does not separate from the support bar 26 during the operation of the heat-exchanger.

Figure 4:
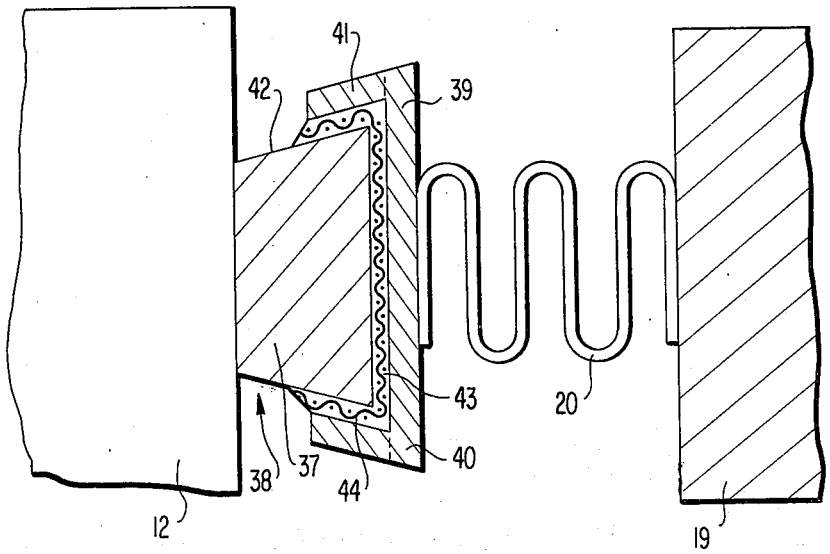
FIG. 4 is a cross-sectional view, similar to FIG. 3, through a modified embodiment of a sealing element in accordance with the present invention.

FIG. 4 illustrates a similar construction of a sealing element in which the graphite blocks 37 of the slide layer 38 have a trapezoidally shaped cross-sectional area. The smaller of the parallel sides thereby abuts at the rotatable storage body 12 whereas the larger side is disposed opposite the bottom portion 39 of the support bar 40. The side portions 41 of the support bar 40 are also angularly bent off obliquely inwardly corresponding to the trapezoidal shape of the graphite blocks 37 and partly surround the sides 42 thereof. The connecting layer 43 is applied at the inner sides of the bottom portion 39 and of the side portions 41, in which are embedded the graphite blocks 37. The connecting layer 43 consists in the thermally particularly strongly loaded corner area which is designated in FIG. 2 by reference character A of a temperature-resistant ceramic putty or cement of conventional type. The corner area includes, for example, four graphite blocks 37 if the slide layer 38 is subdivided in a manner similar to the embodiment according to FIG. 2. In order to prevent a progression of cracks or a breaking out of ceramic particles, a wire mesh 44 of stainless steel is embedded in the putty or bonding material of the connecting layer 43. As to the rest, the connecting layer 43 consists as in the preceding embodiment of silicon rubber of conventional type so that a sufficient compensation for the different thermal expansions remains preserved. The sealing element excels by a very good anchoring of the graphite blocks 37 in the support bar 40. The local use of a ceramic putty or bonding material additionally renders the sealing element particularly heat-resistant without reducing the durability of the connection since the side portions 41 produce an effective support of the graphite blocks 37 and therewith a relief of the connecting layer 43 with respect to thrust loads and stresses.

In lieu of a ceramic putty or bonding material, it is also possible to utilize a heat-resistant cement or similar materials. The commercially available adhesive made and sold by Adhesive Products Corporation, a U.S. corporation, under the name "Thermostix 2000" is a typical example of a high heat-resistant adhesive on a silicate base which can be used in the present invention as ceramic putty or bonding material, though other equivalent high heat-resistant adhesives are also commercially available and can be used with the present invention. In lieu of wire mesh, also individual wires may be arranged in the connecting layer. The local use of particularly heat-resistant materials in the connecting layer may also be used to advantage in the sealing elements described hereinabove or in similar embodiments.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A sealing element between a storage body means and a gas channel means of regenerative heat-exchanger, the sealing element includes a slide layer, a support bar means and a substantially yielding connecting layer disposed therebetween, characterized in that the support bar means includes a bottom portion and two side portions which laterally partly surround the slide layer, the connecting layer being applied to the inner sides of the bottom portion and of the side portions, and the slide layer being embedded in the connecting layer, and in that the side portions of the support bar means are provided with cutouts which extend up to within the area of the bottom portion.

2. A sealing element according to claim 1, characterized in that the slide layer consists of graphite while the support bar means is a metallic support bar.

3. A sealing element according to claim 2, characterized in that the support bar means essentially consists of a bottom portion and of two lateral portions.

4. A sealing element according to claim 1, with a slide layer assembled of individual blocks of slide material, characterized in that the cutouts are arranged within the area of the center of a side of a respective block.

5. A sealing element according to claim 4, characterized in that the blocks are graphite blocks.

6. A sealing element according to claim 4, characterized in that the connecting layer extends into the cutouts in the side portions of the support bar means and substantially fills out the same.

7. A sealing element according to claim 6, characterized in that the connecting layer forms a transition from the top side of the side portions to the two sides of the slide layer, which transition projects beyond the support bar means.

8. A sealing element according to claim 7, characterized in that the connecting layer essentially consists of a yielding material.

9. A sealing element according to claim 8, characterized in that the connecting layer essentially consists of silicon rubber.

10. A sealing element according to claim 8, characterized in that the connecting layer consists of a heat-resistant material at the thermally highly stressed places of the sealing element.

11. A sealing element according to claim 10, characterized in that the connecting layer consists of a heat-resistant ceramic bonding material at those places of the sealing element which are thermally particularly highly stressed.

12. A sealing element according to claim 10, characterized in that a wire means is arranged in the places of the connecting layer consisting of the heat-resistant material.

13. A sealing element according to claim 12, characterized in that said wire means consists of a wire mesh.

14. A sealing element according to claim 13, characterized in that the blocks are graphite blocks.

15. A sealing element according to claim 14, characterized in that the heat-resistant material of the connecting layer is ceramic putty.

16. A sealing element according to claim 15, characterized in that the connecting layer essentially consists of silicon rubber.

17. A sealing element according to claim 1, characterized in that the connecting layer extends into the cutouts in the side portions of the support bar means and substantially fills out the same.

18. A sealing element according to claim 1, characterized in that the connecting layer forms a transition from the top side of the side portions to the two sides of the slide layer, which transition projects beyond the support bar means.

19. A sealing element according to claim 1, characterized in that the connecting layer essentially consists of a yielding material.

20. A sealing element according to claim 19, characterized in that the connecting layer essentially consists of silicon rubber.

21. A sealing element according to claim 19, characterized in that the connecting layer consists of a heat-resistant material at the thermally highly stressed places of the sealing element.

22. A sealing element according to claim 21, characterized in that the connecting layer consists of a heat-resistant ceramic bonding material at those places of the sealing element which are thermally particularly highly stressed.

23. A sealing element according to claim 21, characterized in that a wire means is arranged in the places of the connecting layer consisting of the heat-resistant material.

24. A sealing element according to claim 23, characterized in that said wire means consists of a wire mesh.

* * * * *